US007464529B2

(12) United States Patent
Stahlecker et al.

(10) Patent No.: US 7,464,529 B2
(45) Date of Patent: Dec. 16, 2008

(54) PROCESS AND ARRANGEMENT FOR RESTARTING A PREVIOUSLY INTERRUPTED SPINNING PROCESS

(75) Inventors: Gerd Stahlecker, Eislingen/Fils (DE); Gernot Schaeffler, Waeschenbeuren (DE); Peter Schweier, Geislingen/Steige (DE)

(73) Assignee: Maschinenfabrik Rieter AG, Winterthur (CH)

( * ) Notice: Subject to any disclaimer, the term of this patent is extended or adjusted under 35 U.S.C. 154(b) by 288 days.

(21) Appl. No.: 10/578,919

(22) PCT Filed: Jul. 30, 2004

(86) PCT No.: PCT/EP2004/008603

§ 371 (c)(1),
(2), (4) Date: May 9, 2006

(87) PCT Pub. No.: WO2005/047580

PCT Pub. Date: May 26, 2005

(65) Prior Publication Data

US 2007/0175200 A1 Aug. 2, 2007

(30) Foreign Application Priority Data

Nov. 10, 2003 (DE) ..... 103 53 317

(51) Int. Cl.
*D01H 5/32* (2006.01)

(52) U.S. Cl. ..... 57/263; 57/315; 57/350

(58) Field of Classification Search ..... 57/263, 57/315, 350

See application file for complete search history.

(56) References Cited

U.S. PATENT DOCUMENTS

| | | | | |
|---|---|---|---|---|
| 4,114,358 | A | 9/1978 | Tsuchida et al. | |
| 4,517,794 | A | 5/1985 | Sakai et al. | |
| 5,390,485 | A * | 2/1995 | Mori | 57/328 |
| 5,813,209 | A | 9/1998 | Hirao et al. | |
| 2006/0096271 | A1 * | 5/2006 | Yamamoto et al. | 57/350 |
| 2006/0236673 | A1 * | 10/2006 | Schweier | 57/350 |

FOREIGN PATENT DOCUMENTS

| | | |
|---|---|---|
| EP | 0 807 699 A3 | 11/1997 |
| WO | WO 94/00626 A1 | 1/1994 |

OTHER PUBLICATIONS

International Search Report dated Nov. 23, 2004 including English Translation (Five (5) pages).

* cited by examiner

*Primary Examiner*—Shaun R Hurley
(74) *Attorney, Agent, or Firm*—Crowell & Moring LLP

(57) ABSTRACT

A process and an arrangement for re-starting a previously interrupted spinning process in a spinning arrangement is provided. The arrangement includes a drafting unit which can be shut down and also an airjet unit including a vacuum chamber. For the purpose of removing an initially inhomogeneous fiber stream, a staple fiber strand, delivered by the re-operating drafting unit, is temporarily suctioned as waste via a deflecting device after it has left the drafting unit. Only then, when a homogeneous fiber stream has formed, is the staple fiber strand joined with a thread which is transported through the airjet unit. The inhomogeneous fiber stream is removed with the aid of the low pressure in the vacuum chamber.

21 Claims, 5 Drawing Sheets

B
1
26
25
30
23
24
D
F
4
28
27
16
14
18
29
C
31
E
21
20
15
12,35
19
22
13
17
34
11
6
5
3
9
10
8
7
A
2

B
1
23
24
25
D
F
30
16
27
14
E
33
4
17
18
29
28
C
38
31
21
22
13
15
12
11
37
32
3
5
6
A
2
G
36

B
1
25
D
F
30
27
16
14
E
4
18
17
28
29
C
31
21
22
13
12
15
37
38
11
34
3
5
6
A
2

40
41
T
V
$V_{1B}$
$V_{1A}$
$V_{2B}$
$V_{2A}$
$V_{2R}$
$T_1$
$T_2$
$T_3$
$T_4$
$T_A$
$T_U$
$T_D$
$T_5$
$T_B$

PROCESS AND ARRANGEMENT FOR RESTARTING A PREVIOUSLY INTERRUPTED SPINNING PROCESS

BACKGROUND AND SUMMARY OF THE INVENTION

The present invention relates to a process for re-starting a previously interrupted spinning process in a spinning arrangement, which arrangement comprises a drafting unit which can be shut down and an airjet unit comprising a vacuum chamber, whereby, for the purpose of removing an initially inhomogenous fiber stream, a staple fiber strand, delivered by the re-operating drafting unit, is temporarily suctioned as waste via a deflecting device after it has left the drafting unit, the staple fiber strand being joined with a thread which is transported through the airjet unit only when a homogenous fiber stream has formed.

The present invention relates further to a spinning arrangement for carrying out the process, comprising a drafting unit which can be shut down, also comprising an airjet unit having a fiber feed channel, a thread withdrawal channel and a vacuum chamber, also comprising a deflecting device for temporarily deflecting a staple fiber strand, delivered by the drafting unit, from a thread to be joined thereto.

A process and an arrangement of this type is prior art in the international published application WO 94/00626. This publication refers in general to airjet spinning arrangements without their specific embodiments and deals with the re-starting of a previously interrupted spinning process, when, for example an end break occurs for some reason. In this case, the end of an already spun thread must be first guided back to the drafting unit after an interruption in the spinning process has occurred. The shut down drafting unit can then be set in operation again and the newly delivered staple fiber strand be joined to the end of the thread. Because the staple fiber strand has been torn in the drafting unit due to the interruption in the spinning process and the associated shutting down of the drafting unit, a staple fiber strand forms when the drafting unit is operating again which is initially relatively inhomogeneous at its start. For this reason, it is provided in the known process and in the known spinning arrangement that the initially inhomogeneous fiber stream is temporarily sucked off as waste and not immediately joined with the end of the thread fed back to the drafting unit. Only after a homogeneous fiber stream is formed is the staple fiber strand joined with the thread transported through the airjet unit. This permits the creation of a joining point of significantly improved quality for the joining process—so-called piecing—of the re-delivered staple fiber strand with the thread, in that, instead of an arbitrarily produced initial piece of the staple fiber strand caused by tearing, a newly generated initial piece of the staple fiber strand is joined with the thread, whereby the new initial piece is generated from a fiber stream which is homogeneous again. A suction tube located between the drafting unit and the airjet unit serves for the temporary suction of the inhomogeneous fiber stream.

In non-generic European published patent 0 807 699, the piecing of a staple fiber strand to the end of a thread in a very specific airjet spinning arrangement is known. In the case of this spinning arrangement, the drafted staple fiber strand is first fed through a fiber feed channel of the airjet unit into a vortex chamber, to which a fluid device is arranged for generating a vortex current around the entry opening of a thread withdrawal channel. Initially, the front ends of the fibers held in the staple fiber strand are guided into the thread withdrawal channel, while rear free fiber ends spread out, are seized by the vortex current and wound around the front ends already located in the entry opening of the thread withdrawal channel, that is, around the front ends already bound in, whereby a thread with a mostly real twist is formed. In this known spinning arrangement also, the initial piece of the delivered staple fiber strand is at first subjected to suction after the drafting unit is operational again, however in a suction tube located between the drafting unit and the airjet unit and, in addition, together with the end of the thread with which the staple fiber strand is to be joined. The initial piece of the staple fiber strand and the end of the thread fed back to the drafting unit are stored temporarily in one and the same suction device. Thus, a relatively arbitrary connection of the suctioned staple fiber strand with the likewise suctioned thread is formed, whereby a good quality piecing point is not specifically targeted. In the case of a spinning arrangement of this type in a real embodiment, a splicing arrangement is provided—which is not mentioned in the publication—which subsequently cuts out the connecting point after piecing of the staple fiber strand to the thread and replaces it with a splice point of better quality.

It is an object of the present invention in the case of a process and a spinning arrangement of the above mentioned type to create a homogeneous fiber stream and to carry out the joining of the fiber staple strand with the end of the thread in a particularly effective way.

This object has been achieved in that the inhomogeneous fiber stream is removed with the aid of a vacuum prevailing in the vacuum chamber.

In the case of the spinning arrangement, the object of the present invention is achieved accordingly in that the vacuum chamber is incorporated into the deflecting device. The vacuum chamber is connectable to the drafting unit via a connecting channel.

Due to of the features of the present invention, the inhomogeneous fiber stream is not deflected by an external suction device, but rather a device already present in the spinning arrangement is used to remove the inhomogeneous fiber stream. The vacuum chamber in the airjet unit is needed during normal operation in order to evacuate the compressed air fed to the vortex chamber and simultaneously to transport away the inevitable fiber waste unavoidable in this spinning process. This vacuum can be utilized for the purposes of the present invention to initially deflect the inhomogeneous fiber stream from the end of thread, with which a homogeneous fiber stream is then joined. The vacuum present in the vacuum chamber during operation is advantageously increased temporarily in order to remove the inhomogeneous fiber stream. Thus, the inhomogeneous fiber stream is easier to deflect from its operational transport path, as travelled during the normal spinning process. With correct timing, the overlapping area of the initial piece of the homogeneous fiber stream with the end of the thread can be kept very narrow, so that only a very small slub occurs, which can be regarded as an acceptable fault not visible in the end product, for example in woven material.

In one variation, it is provided that the staple fiber strand is deflected from its operational transport path inside the airjet unit. Initially, the inhomogeneous fiber stream thus enters into the inside of the airjet unit as in normal spinning operation, and is however temporarily deflected as waste therein. As a result, the piecing of the homogeneous fiber stream to the end of the thread also takes place in the inside of the airjet spinning unit, as soon as the temporarily increased low pressure is reduced again to the normal level for the spinning process.

In a further variation, it is provided that the staple fiber strand is deflected between the drafting unit and the airjet unit from its operational transport path. The inhomogeneous fiber stream travels temporarily not on its normal path into the inside of the airjet unit, but rather in another way. This is purposeful because the entry opening into the airjet unit usually has very small dimensions and therefore the fiber mass, including the piecing thread, cannot be threaded correctly through this small opening, in particular in the case of coarse yarns and high delivery speeds. In this case, the joining of the homogeneous fiber stream with the end of the thread partly takes place before the airjet unit is reached.

In order that the amount of inhomogeneous fiber stream discharged as waste is kept as small as possible, it is advantageously provided in the embodiment of the present invention that the fiber mass of the staple fiber strand during the removal of the inhomogeneous fiber stream is reduced. The staple fiber strand is fed from the drafting unit initially at a reduced delivery speed, whereby in this way also, due to the deflection of the staple fiber strand from the normal transport path, a homogeneous fiber stream is achieved after a certain length of time.

Although in the course of the present invention, the end of the thread to be pieced, which is fed back to the drafting unit, is fed back through the delivery roller pair of the drafting unit, it should be expressly pointed out that the end of the thread can also be held ready between the airjet unit and the drafting unit in a practical way.

In the spinning arrangement according to the present invention, it is advantageously provided that the vacuum chamber is equipped with a connecting element for temporarily increasing the low pressure. This can be, for example, a suction connection, which can be connected to a separate low pressure source, which is either stationary or applied to a travelling maintenance device. It is advantageously provided however, that the connecting element comprises an injector channel which can be charged with compressed air. This is a particularly effective way to increase the low pressure, especially as a compressed air injection is advantageous for the piecing process in any case.

In the case of the vacuum chamber connected to the drafting unit, a connecting channel can, in one variation, be the fiber feed channel, used in the regular spinning process, from which the thread withdrawal channel can preferably be separated. This is a simple solution without any complicated additional technical steps, especially as the separation of the thread withdrawal channel from the fiber feed channel for threading the thread and for cleaning the vortex chamber is advantageous in any case.

Particularly advantageous is, however, a separate bypass channel. This is advantageously provided in one variation with a closing device, which closes the bypass channel during the normal spinning process, while opening it for the purposes of deflecting the inhomogeneous fiber stream. A travelling maintenance device can actuate this process.

In a further variation, a cleaning channel directed against the drafting unit during operation can function as the bypass channel. In this case, the bypass channel does not need to be closed during operation, as the delivery roller pair of the drafting unit is constantly cleared of fiber fly by way of suction action via this bypass channel. In order to deflect the inhomogeneous fiber stream, the low pressure in the vacuum chamber can be temporarily increased, so that the fiber stream is deflected easily from its normal transport path by way of the cleaning channel.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
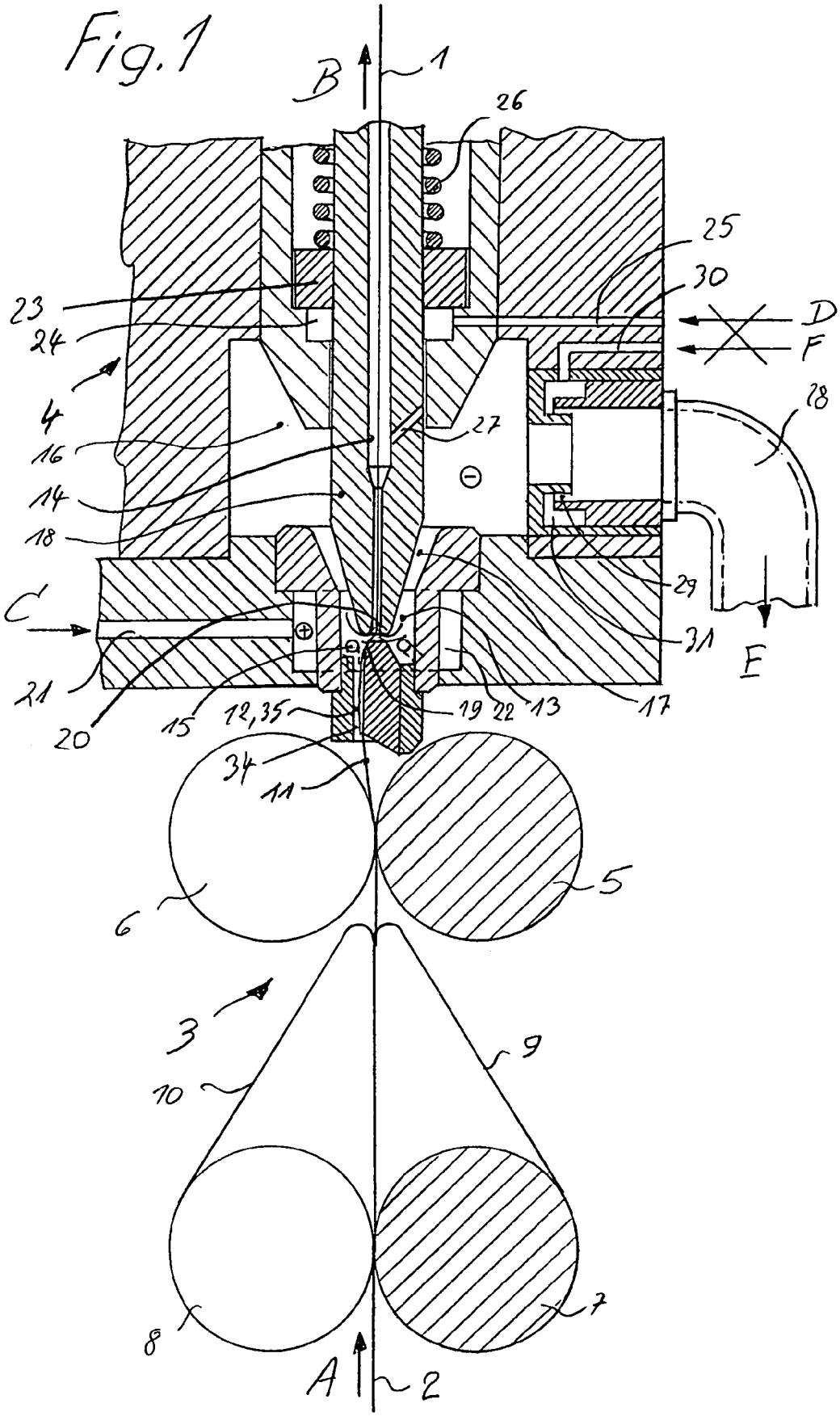
FIG. 1 shows an axial intersection of a spinning arrangement during operation in the area concerning the present invention.

The spinning arrangement shown in FIG. 1, which shows the normal spinning process, serves to produce a spun thread 1 from a staple fiber strand 2. The spinning arrangement includes a drafting unit 3 and an airjet unit 4.

The staple fiber strand 2 is fed to the drafting unit 3 in drafting direction A and withdrawn as a spun thread 1 by withdrawal rollers (not shown) in withdrawal direction B and guided to a winding device (not shown). The only partly shown drafting unit 3 is preferably a three-cylinder drafting unit and includes therefore three roller pairs, each of which includes a driven bottom roller and an upper roller designed as a pressure roller. Only the delivery roller pair 5, 6, as well as an apron roller pair 7, 8 arranged upstream thereof and having guiding aprons 9, 10, are shown. In a drafting unit 3 of this kind, a staple fiber strand 2 is drafted in the known way to the desired degree of fineness. Directly downstream of the drafting unit 3, a thin fiber strand 11 is present, which is drafted and still twist-free.

The fiber strand 11 is fed via a fiber feed channel 12 to the airjet unit 4. Downstream thereof lies a so-called vortex chamber 13, in which the fiber strand 11 receives its spinning twist, so that the spun thread 1 is formed, which is withdrawn through a thread withdrawal channel 14.

A fluid device generates a vortex current during the spinning process in the vortex chamber 13 by blowing in compressed air through compressed air nozzles 15, which run tangentially into the vortex chamber 13. The compressed air exiting out of the nozzle openings is discharged via an evacuation channel 17, which runs into a vacuum chamber 16, whereby the channel 17 has a ring-shaped cross section around a spindle-shaped component 18, which is stationary during operation and which contains the thread withdrawal channel 14.

An edge of a fiber guiding surface 19, acting as a twist block, is arranged in the area of the vortex chamber 9. The fiber guiding surface 19 is slightly eccentrically arranged to the thread withdrawal channel 14 in the area of its entry opening 20.

In the airjet unit 4, the fibers to be spun are, on the one hand, held together in a fiber strand 11, and thus fed from the fiber feed channel 12 into the thread withdrawal channel 14 essentially without a spinning twist, while on the other hand the fibers in the area between the fiber feed channel 12 and the thread withdrawal channel 14 are exposed to the vortex current. The vortex current causes the fibers, or at least their end areas to be driven away radially from the entry opening 20 of the thread withdrawal channel 14. The threads 1 produced by the above described spinning arrangement display a core comprising fibers or fiber areas extending essentially in the thread longitudinal direction without any significant twist, and an outer area in which the fibers or fiber areas are wrapped around the core. A spinning arrangement of this type permits very high spinning speeds, which lie in the range between 300 and 600 m per minute.

The compressed air exiting out of the compressed air nozzles 15 into the vortex chamber 13 is fed to the airjet unit 4 during operation via a compressed air channel 21 in feed direction C. From the compressed air channel 21, the compressed air reaches first a ring channel 22 which surrounds the vortex chamber 13, to which the above mentioned compressed air nozzles 15 are directly connected.

During the operational spinning process, there is a very small distance between the entry opening 20 of the thread withdrawal channel 14 and the fiber feeding surface 19, which small distance can measure, for example, 0.5 mm. This small distance is adjusted in that the spindle-shaped component 18 containing the thread withdrawal channel 14 is arranged in such a way that it is movable in an axial direction. The selected distance can be fixed during the operational state. In order to increase the distance, as can be seen in FIG. 2, the spindle-shaped component 18 is designed partly as a piston-like component of a piston-cylinder unit.

Figure 2:
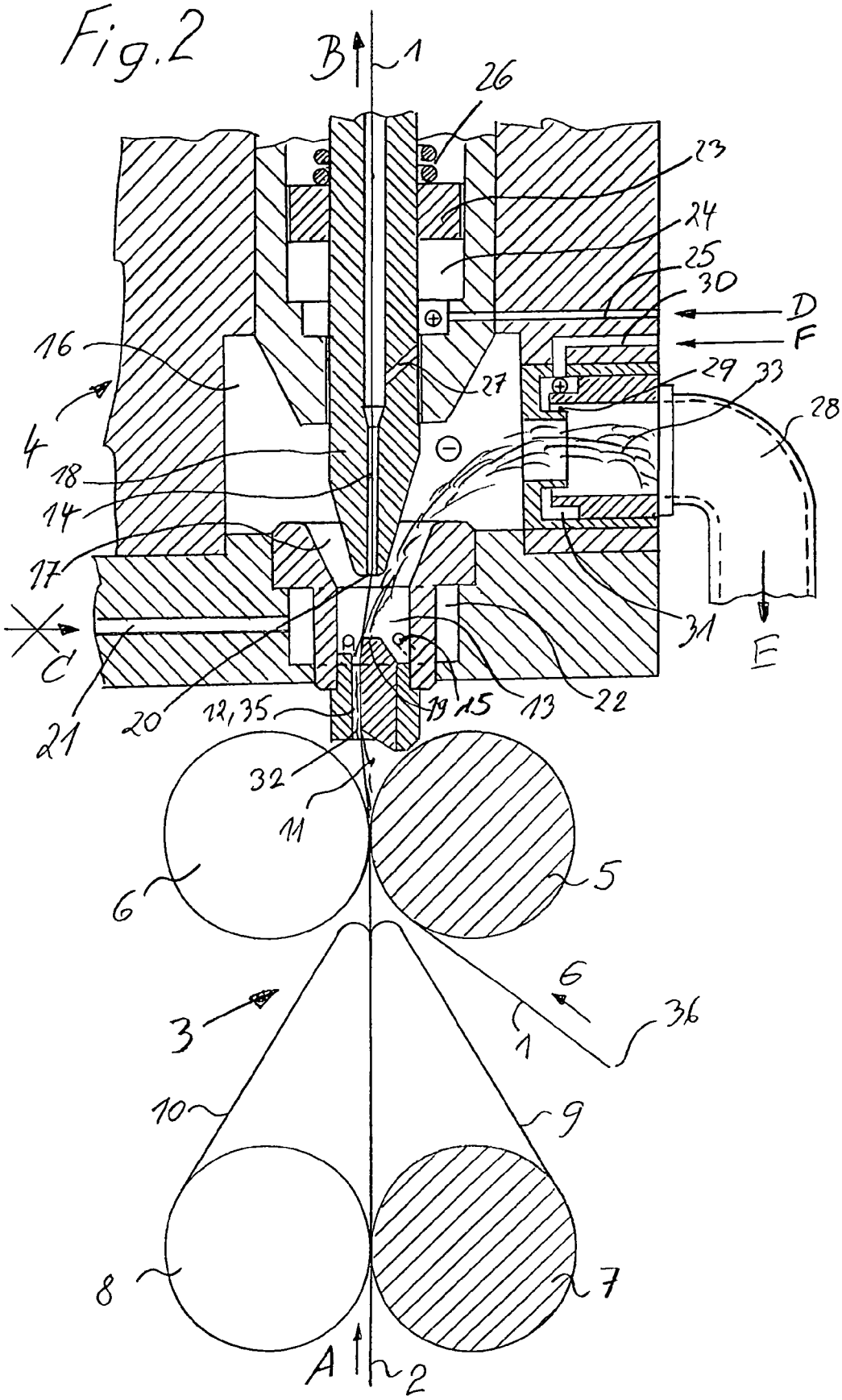
FIG. 2 shows a spinning arrangement according to FIG. 1 during removal of the inhomogeneous fiber stream.

When for any reason the fiber strand 11 or the thread 1 breaks, the compressed air being fed to the vortex chamber 13 is first cut off (see the crossed arrow C in FIG. 2). At the same time, all drives of the drafting unit 3 and of the thread withdrawal rollers (not shown) and the winding device (not shown) are switched off.

Because the spindle-like component 18 is partly designed as a piston-like component, the thread withdrawal channel 14 may be moved away from the fiber feed channel 12 using very simple means. Thus, for example, a ring channel 24 surrounding the spindle-like component 18 is provided, through which ring channel 24 the piston-like component 18 extends and which is connected to a conduit 25 for compressed air. This compressed air, see arrow D in FIG. 2, and the arrow crossed through in FIG. 1, is fed only when the spinning process is interrupted. The compressed air entering into the ring channel 24 moves the piston-like component 18 upwards as shown in the view in FIG. 2, so that the ring channel 24 increases due to the piston stroke to become an enlarged ring chamber. The limiting piston 23 affixed to the spindle-like component 18 thus borders the ring channel 24 during operation and the enlarged ring chamber when the spinning process is interrupted. The limiting piston 23 acts hereby against a loading spring 26, which presses the piston-like component 18 into a secure operational position when the compressed air is cut off, that is, during the spinning process. The compressed air fed in via the conduit 25 serves to move away the thread withdrawal channel 14 from the fiber feed channel 12, while the loading spring 26 serves as the return movement.

The very small distance between the fiber guiding surface 19 and the entry opening 20 of the thread withdrawal channel 14 during operation can be increased by the moving away of the spindle-like component 18 when the spinning process is interrupted, which permits the cleaning of the space between fiber guiding surface 19 and the entry opening 20.

When the thread withdrawal channel 14 is separated from the fiber feed channel 12, the broken end 36 of the spun thread 1 can be fed back to the drafting unit 3 against withdrawal direction B (see FIG. 2). An injector channel 27 is provided as an auxiliary means, which can be connected to the same pressure source as the ring channel 24 and whose mouthpiece is connected to the thread withdrawal channel 14 and is directed towards its entry opening 20. Thus, a suction current directed against the drafting unit 3 is generated in the thread withdrawal channel 14, which suction current guides the end 36 of the spun thread 1 to the delivery roller pair 5, 6.

The compressed air fed via the conduit 25 to the ring channel 24 serves, as can be seen, not only for moving the spindle-like component 18 away from the fiber feed channel 12, but also serves as an injector air current via the injector channel 27, which permits threading of the thread end 36 of the thread 1 to be pieced to the staple fiber strand 2. The piston-like component is designed to a certain extent as a valve, which is actuated by the feeding of compressed air and which establishes an effective connection between the conduit 25 and the injector channel 27.

When the drives of the drafting unit 3, the thread withdrawal rollers (not shown), and of the winding device, are switched on again after an interruption in the spinning process, a poor quality connection point between the staple fiber strand 2 and the end 36 of the thread 1 would occur if particular measures were not taken. It is to be taken into consideration that, when the spinning process is interrupted, the staple fiber strand 2 in the drafting unit 3 tears in a relatively uncontrolled way between the guiding aprons 9, 10 and the delivery roller pair 5, 6. The initial piece of the staple fiber strand 2, which is initially fed at the re-start of the spinning process, does not possess the necessary regularity, whereby the irregularity is multiplied by the high draft which takes place between the apron roller pair 7, 8 and the delivery roller pair 5, 6. An undesirable extreme variation in mass during piecing could occur. It is, therefore, provided that the initial piece of the inhomogeneous fiber stream 32 (see FIG. 2) is removed as waste 33, namely until the moment that the staple fiber strand 2 produces a homogeneous fiber stream 34 (see FIG. 1). The inhomogeneous fiber stream 32 is initially deflected by a so-called fiber stream deflection, so that these deficient fibers are not joined to the end 36 of the thread 1 in the critical piecing area. The fiber stream deflection thus ensures that the initial unfavorable fiber mass distribution does not impair the piecing process.

A fiber stream deflection per se is already known from the above acknowledged prior art. In the case of this known device, an external suction tube for discharging the inhomogeneous fiber stream is provided between the delivery roller pair 5, 6 and the entry of the fiber feed channel 12. In contrast thereto, it is provided in the present invention to utilize the vacuum chamber 16 already present in the airjet unit 4 for deflecting the inhomogeneous fiber stream 32, instead of using a separate external vacuum source.

According to the embodiment shown in FIGS. 1 and 2, the inhomogeneous fiber stream 32 is deflected as waste 33 in the inside of the airjet unit 4. The low pressure in the vacuum chamber 16 is maintained even in the case of an interruption in the spinning process, while, as mentioned above, the compressed air feed via the compressed air channel 21 is interrupted. In order to keep the inhomogeneous fiber stream 32 away from the thread 1 to be pieced, it is provided in the embodiment of the present invention that the low pressure present in the vacuum chamber 16 is temporarily increased. The fibers to be removed as waste 33 can thus be easily evacuated via a connecting vacuum channel 28 in suction direction E. When the temporary increase in the low pressure present in the vacuum chamber 16 ceases and the high pressure fed into the vortex chamber 13 is simultaneously fed in again, the henceforth homogeneous fiber stream 34 of the staple fiber strand 2 follows on its own accord the thread 1 through the yarn withdrawal channel 14, whereby a sufficiently good quality piecing process takes place, which does not need to be subsequently removed by a splice connection. If the end 36 of the thread 1 has exact dimensions and is prepared in the known way, the piecing process can be controlled in such a way that the overlapping area between the end 36 of the thread 1 and the initial piece of the staple fiber strand 2 is very short.

The temporary increase in low pressure in the vacuum chamber 16 can take place in a variety of ways. According to the present invention, a connecting element 30 is provided for the vacuum chamber 16. This connecting element 30 can include a second injector channel 29 which can be charged with compressed air. In order to remove the inhomogeneous fiber stream 32, a compressed air stream is initially fed via the connecting element 30 in arrow direction F, whereby the compressed air reaches first a ring channel 31 and then the second injector channel 29, which is directed against the vacuum channel 28 and in suction direction E. This results in a significant increase in the low pressure in the vacuum chamber 16, so that the inhomogeneous fiber stream 32 is deflected in a simple way from its operational transport path, that is, from the thread withdrawal channel 14.

In the embodiments according to FIGS. 1 and 2, the fiber feed channel 12 already present is used as a connecting channel 35. In order to facilitate the separation of the inhomogeneous fiber stream 32 and the thread 1, the spindle-shaped component 18 is moved a short distance from the fiber guiding surface 19, as already described above, but only so far that the first injector channel 27 does not quite reach the ring channel 24. The thread 1 is nevertheless hereby transported through the thread withdrawal channel 14 in transport direction G due to its already present strength.

The piecing process is chronologically programmed so that the end 36, with which the homogeneous fiber stream 34 is to be joined, reaches the area of the vortex chamber 13 when the inhomogeneous fiber stream 32 is removed completely. At this instant, the normal, lower spinning low pressure in the vacuum chamber 16 is switched on again and the compressed air fed to the vortex chamber 13 is switched on. The spindle-shaped component 18 must, of course, also be guided back into its operational area, which takes place by cutting off the compressed air stream D.

In the following descriptions of alternative embodiments of the present invention, there is no repeat description of the individual components as long as the same components as in FIGS. 1 and 2 are involved. The following description is limited therefore to those components which occur in the variations of the embodiment and which differ from those in FIGS. 1 and 2.

Figure 3:
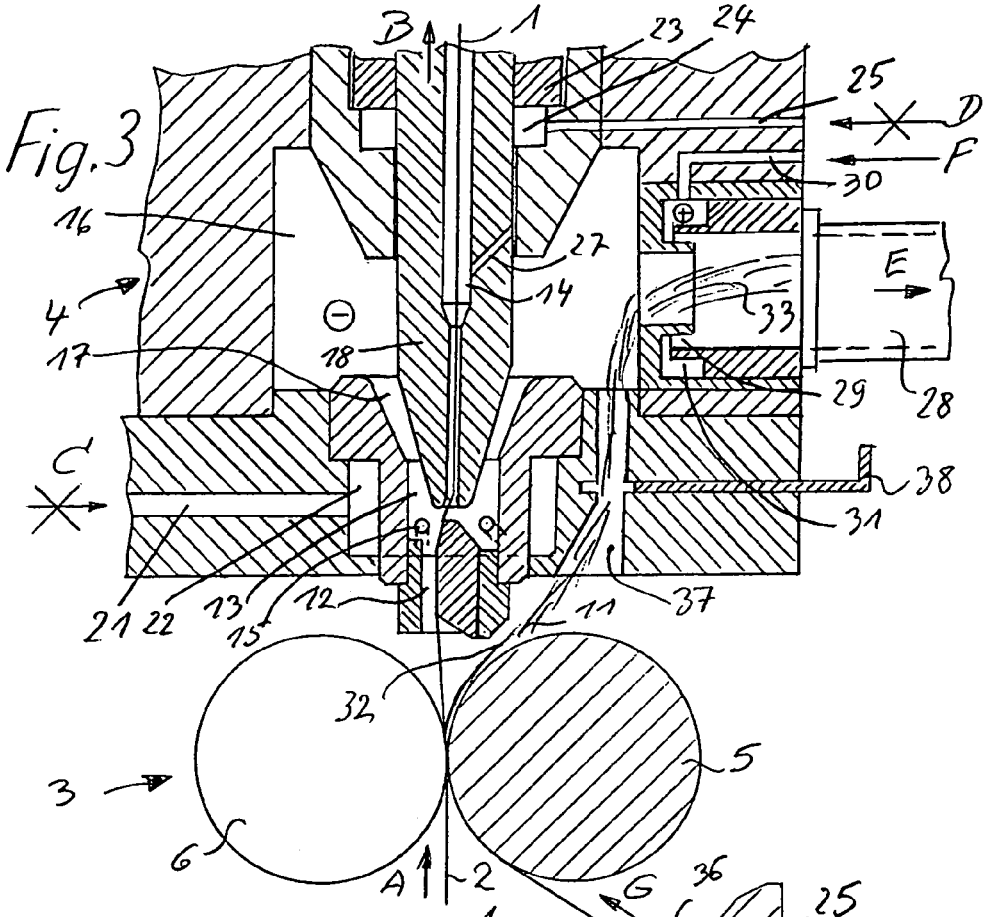
FIG. 3 shows an axial intersection of another embodiment of a spinning arrangement during removal of the inhomogeneous fiber stream.
Figure 4:
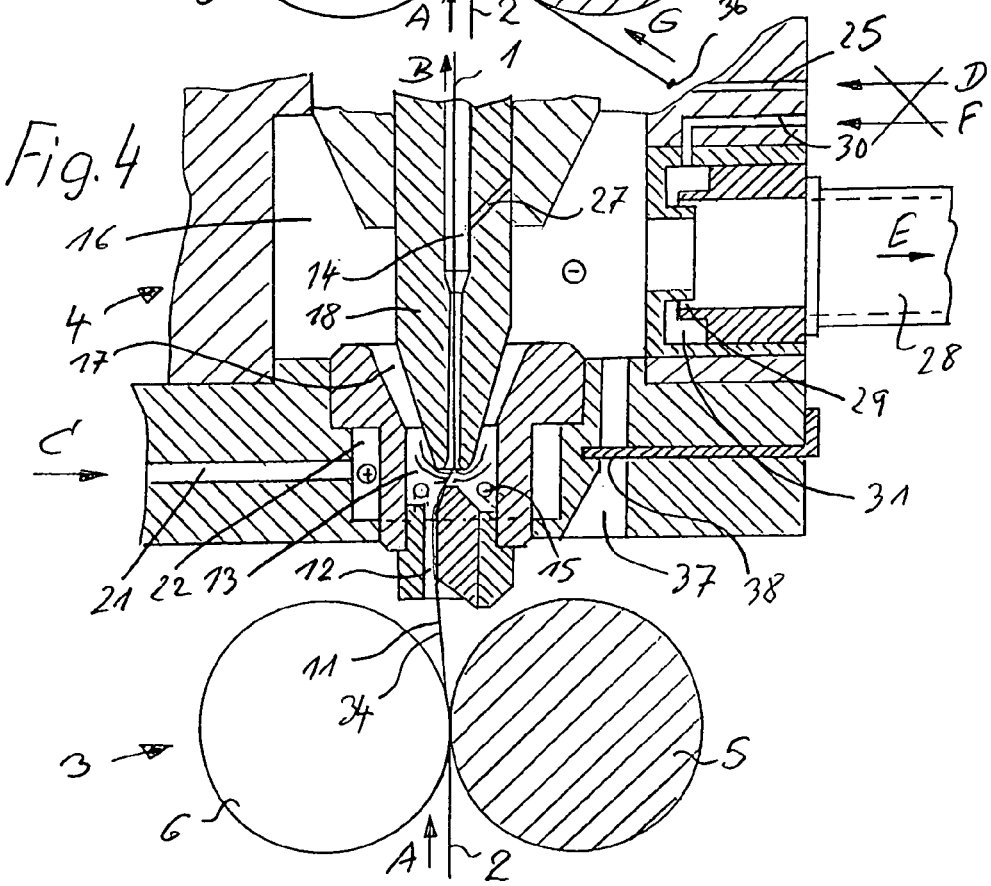
FIG. 4 shows the spinning arrangement according to FIG. 3 during normal spinning operation.

In the embodiment according to FIGS. 3 and 4, the inhomogeneous fiber stream 32 is not deflected in the inside of the airjet unit 4, but rather between the delivery roller pair 5, 6 of the drafting unit 3 and the airjet unit 4. For this reason a bypass channel 37 is provided as a connecting channel between the drafting unit 3 and the vacuum chamber 16, which bypass channel 37 extends approximately parallel to the fiber feed channel 12 in close proximity thereto. This bypass channel 37 can be closed during operation by a closing device 38, and during the removal of the inhomogeneous fiber stream 32 temporarily opened, for example by means of a travelling maintenance device. FIG. 3 shows the opened state of the bypass channel 37, while FIG. 4 shows the closed state. With the aid of FIG. 3, it can be seen how the inhomogeneous fiber stream 32 reaches the vacuum chamber 16 by way of the bypass channel 37, and how it gets from the vacuum chamber 16 into the vacuum channel 28 and is removed in suction direction E. In this embodiment it is also advantageous and therefore provided that, during the removal of the inhomogeneous fiber stream 32, the low pressure in the vacuum chamber 16 is temporarily increased in the manner described above.

The embodiment in FIGS. 3 and 4 is particularly advantageous when there is a risk, especially in the case of coarse yarns and high delivery speeds, that the entry of the fiber feed channel 12 is too small for re-feeding the staple fiber strand 2. In contrast, the opening of the bypass channel 37 can be designed sufficiently large.

It should be noted here that in all the embodiments described above, the airjet unit 4 can, if required, also be swivelled out of its operating position, in order to facilitate the deflection of the inhomogeneous fiber strand 32.

Figure 5:
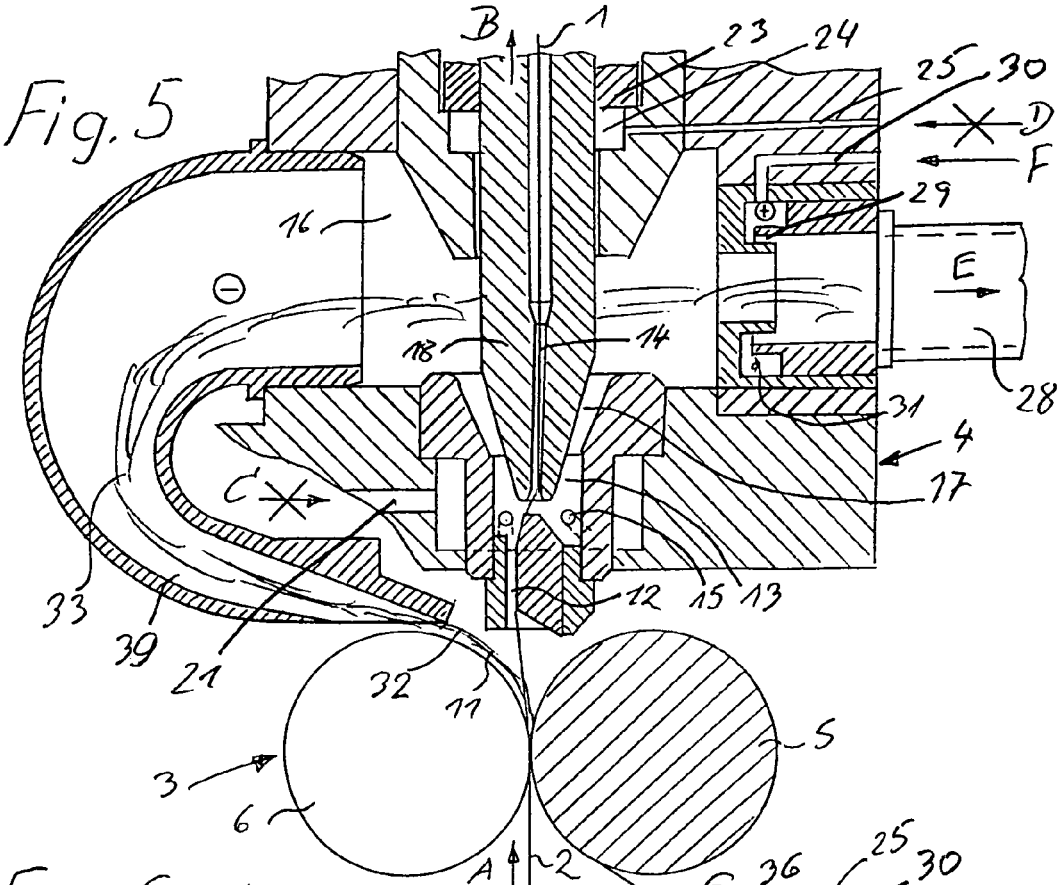
FIG. 5 shows an axial intersection of a further spinning arrangement during removal of the inhomogeneous fiber stream.
Figure 6:
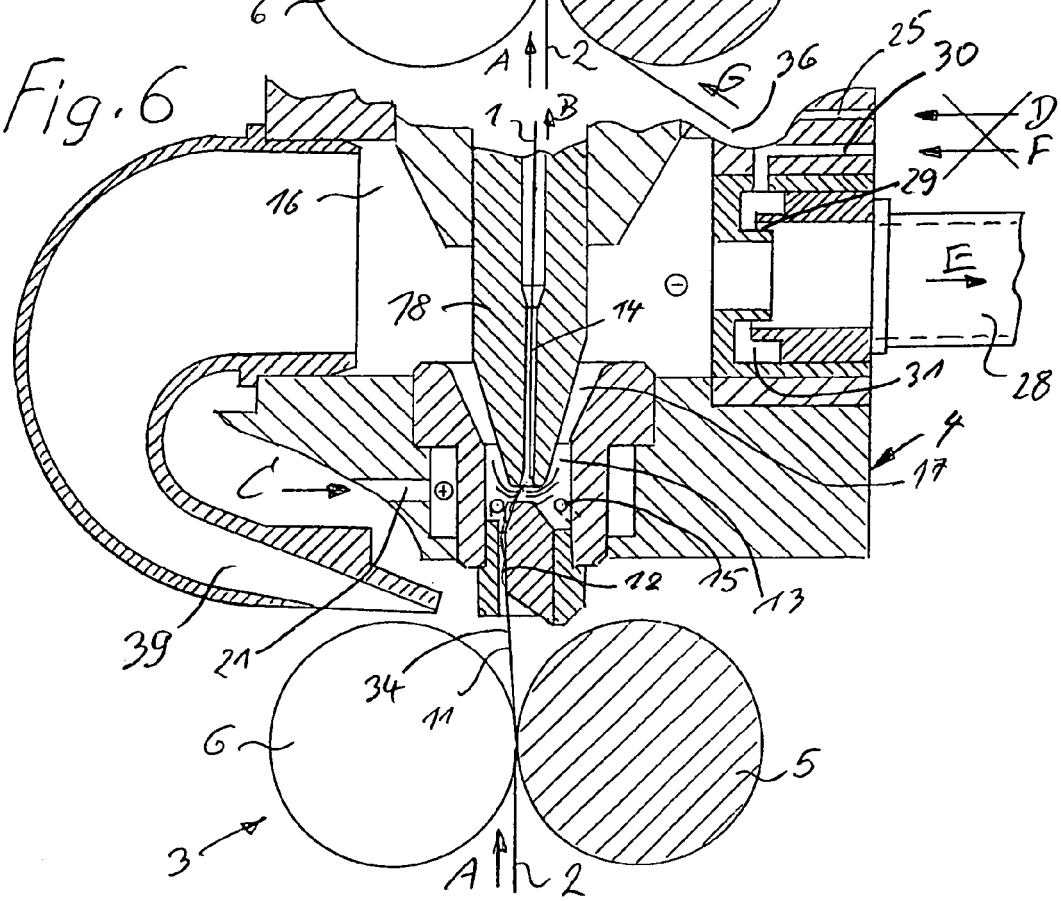
FIG. 6 shows the spinning arrangement according to FIG. 5 during operation.

In the embodiments of FIGS. 5 and 6, a separate bypass channel is also provided for the removal of the inhomogeneous fiber stream 32, which, however, in this case cannot be closed, as it has a function during the normal spinning process. According to FIGS. 5 and 6, a cleaning channel 39 directed against the delivery roller pair 5, 6 of the drafting unit 3 is used as a bypass channel.

During the spinning process, when the normal level of low pressure prevails in the vacuum chamber 16, the cleaning channel 39 serves to continuously clean fiber fly or other impurities from the top roller 6 which is, as a rule, rubber-coated. This cleaning channel 39 can now be used for removing the inhomogeneous fiber stream 32 according to the present invention, which fiber stream 32 is fed into the vacuum channel 28 as waste 33. In this embodiment, for the purposes of removing the inhomogeneous fiber stream 32, the level of low pressure in the vacuum chamber 16 is also temporarily increased in the manner described above. The fibers of the staple fiber stream 2, which are transported again, do not initially follow the thread 1 into the fiber feed channel 12, but rather a part of the periphery of the top roller 6 into the cleaning channel 39.

Figure 7:
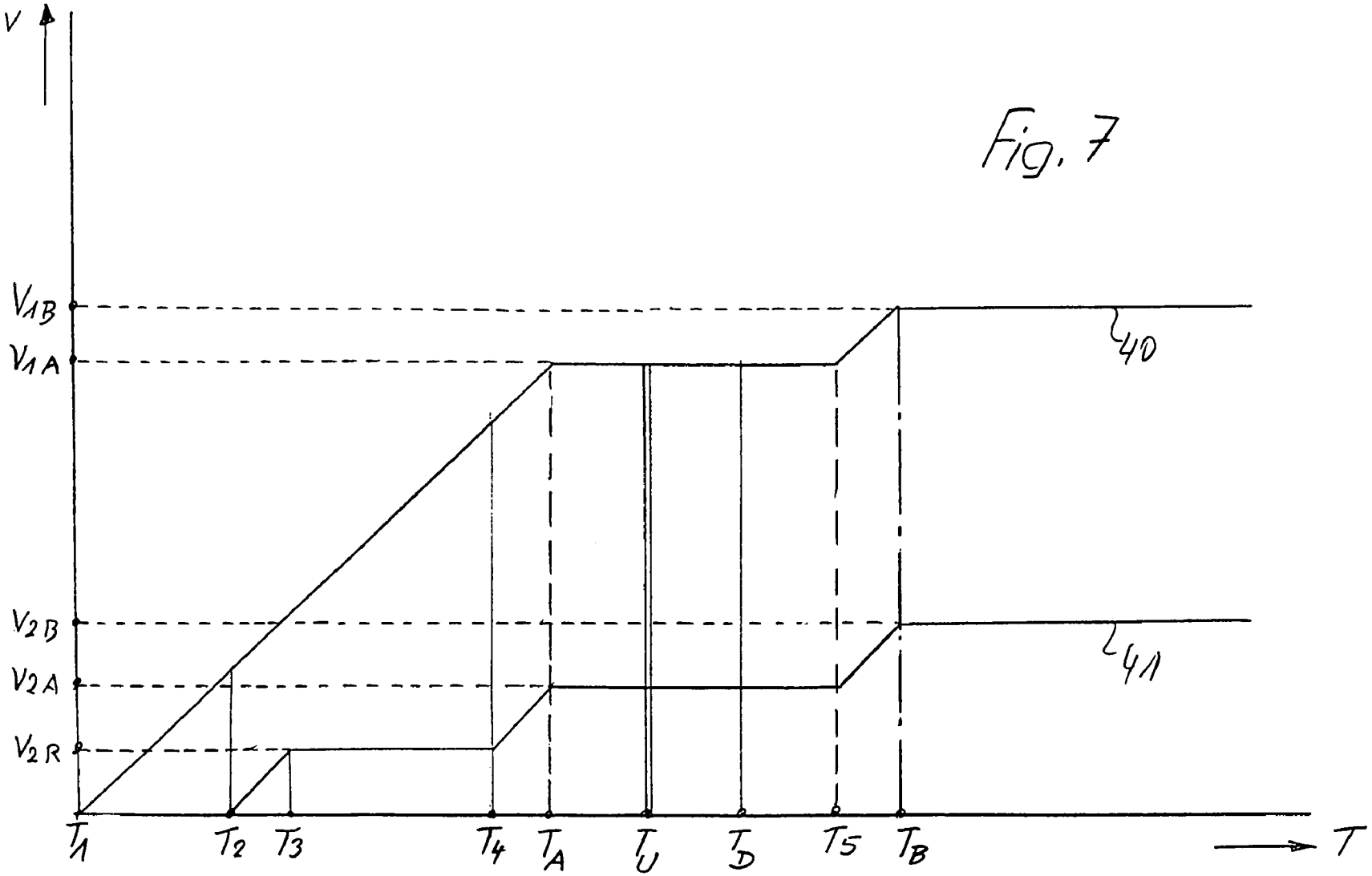
FIG. 7 shows a diagram to illustrate the delivery speeds of the delivery rollers of the drafting unit.

With the aid of FIG. 7, the speeds of the delivery roller pair 5, 6 and the apron roller pair 7, 8 during the piecing process are illustrated. The term "speed" is understood as the transport speed of the staple fiber strand 2, that is, the respective peripheral speed of the roller pairs 5, 6 and 7, 8.

The curve 40 shows the speed v for the delivery roller pair 5, 6, while the curve 41 shows the speed v for the apron roller pair 7, 8. It should be mentioned at this point that, during an interruption of the spinning process, controlled by the respective drives, the staple fiber strand 2 was torn between the guiding apron 9, 10 and the delivery roller pair 5, 6.

The abscissa of the diagram in FIG. 7 shows the time T, and the ordinate shows the speed v.

It is presumed that at a time $T_1$ the piecing process is begun by switching on the drives of the delivery roller pair 5, 6. It can be seen that from a time $T_1$ onwards the speed of the delivery roller pair 5, 6 initially increases according to the curve 40, namely up to a constant piecing speed $v_{1A}$, which is reached by a time $T_A$. From this time $T_A$ onwards, the delivery roller pair 5, 6 initially runs at a reduced—in comparison to the operational speed $v_{1B}$—but constant piecing speed $v_{1A}$.

Because the apron roller pair 7, 8 does not initially re-start, only the thread 1, but not the staple fiber strand 2, is transported in withdrawal direction B. The delayed start-up of the apron roller pair 7, 8 serves to bring the end 36 of the thread 1 to a defined position, in which the actual piecing process, that is the joining of the homogeneous fiber stream 34 with the end 36 of the thread 1, takes place. According to FIG. 7, it is provided that the start of the apron roller pair 7, 8 takes place at a time $T_2$, that is, slightly delayed in relation to the start of the delivery roller pair 5, 6.

As soon as the apron roller pair 7, 8 is set in motion, the transport of the staple fiber strand 2 begins, whose initial piece reaches the nipping point of the delivery roller pair 5, 6 very rapidly and is then, also slightly delayed, transported through this delivery roller pair 5, 6. The staple fiber strand 2, however, initially comprises in the described way an inhomogeneous fiber stream 32, which is to be deflected in the manner described above. In order that not too much fiber mass is removed as waste 33, it is initially provided that the apron roller pair 7, 8 is not yet accelerated to its piecing speed $v_{2A}$, but rather to a much more reduced intermediate speed $v_{2R}$. This intermediate speed $v_{2R}$ is found between the times $T_3$ and $T_4$. In this timespan, a greater part of the waste 33 is removed. At the time $T_4$, the apron roller pair 7, 8 is accelerated to its piecing speed $v_{2A}$, which is reached at the time $T_A$.

As soon as the delivery roller pair 5, 6 and the apron roller pair 7, 8 have both reached their piecing speeds $v_{1A}$ and $v_{2A}$, the last piece of the inhomogeneous fiber stream 32 is removed as waste 33. Shortly after the fiber stream deflection process described above takes place, however, at a time $T_U$, the increased level of low pressure in the vacuum chamber 16 is lowered again and the compressed air feed in the vortex chamber 13 is started in via the compressed air channel 21. From time $T_U$ onwards, a homogeneous fiber stream 34 is formed, which, from this time on, takes up its operational transport path. Shortly thereafter, at a time $T_D$, the actual piecing takes place, that is, the joining of the homogeneous initial piece of the staple fiber strand 2 with the end 36 of the thread 1. It is presumed that the entire piecing process is completed at a time $T_5$. From this time onwards, the delivery roller pair 5, 6 and the apron roller pair 7, 8 will accelerate to their operational speeds $v_{1B}$ and $v_{2B}$. Then the piecing process is completed.

The invention claimed is:

1. A process for re-starting a previously interrupted spinning process in a spinning arrangement, which spinning arrangement comprises a drafting unit including a vacuum chamber, wherein after shutting down the drafting unit, the process for restarting comprises the acts of:

delivering a staple fiber strand upon re-operating the drafting unit;

temporarily suctioning the staple fiber strand as waste via a deflecting device after the staple fiber strand has left the drafting unit wherein an initially inhomogeneous fiber stream is removed using a low pressure prevailing in the vacuum chamber; and joining the staple fiber strand with a thread transported through the airjet unit only when a homogeneous fiber stream has formed.

2. The process according to claim 1, wherein an operational level of low pressure prevailing in the vacuum chamber is temporarily increased for the purpose of removing the inhomogeneous fiber stream.

3. The process according to claim 1, wherein the staple fiber strand is deflected from an operational transport path in an interior of the airjet unit.

4. The process according to claim 2, wherein the staple fiber strand is deflected from an operational transport path in an interior of the airjet unit.

5. The process according to claim 1, wherein the staple fiber strand is deflected from an operational transport path between the drafting unit and the airjet unit.

6. The process according to claim 2, wherein the staple fiber strand is deflected from an operational transport path between the drafting unit and the airjet unit.

7. The process according to claim 1, wherein a fiber mass of the staple fiber strand is reduced during removal of the inhomogeneous fiber stream.

8. A spinning arrangement, comprising:

a drafting unit for feeding a staple fiber strand, which drafting unit can be shut down when an interruption in the spinning process occurs;

an airjet unit having a fiber feed channel, a thread withdrawal channel, and a vacuum chamber;

a deflecting device for temporarily deflecting a complete staple fiber strand, delivered by the drafting unit, from a thread to be joined thereto;

wherein the vacuum chamber is included in the deflecting device and has its low pressure temporarily increased for deflecting the complete fiber strand, the vacuum chamber being connectable to the drafting unit via a connecting channel.

9. A spinning arrangement, comprising:

a drafting unit which can be shut down when an interruption in the spinning process occurs;

an airjet unit having a fiber feed channel, a thread withdrawal channel, and a vacuum chamber;

a deflecting device for temporarily deflecting a staple fiber strand, delivered by the drafting unit, from a thread to be joined thereto;

wherein the vacuum chamber is included in the deflecting device, the vacuum chamber being connectable to the drafting unit via a connecting channel;

wherein the vacuum chamber is provided with a connecting element for temporarily increasing a level of low pressure in the vacuum chamber.

10. The spinning arrangement according to claim 9, wherein the connecting element comprises an injector channel which is supplyable with compressed air.

11. The spinning arrangement according to claim 9, wherein the fiber feed channel, used in a regular spinning process, is used as a connecting channel, from which fiber feed channel the thread withdrawal channel is preferably separable.

12. The spinning arrangement according to claim 10, wherein the fiber feed channel, used in a regular spinning process, is used as a connecting channel, from which fiber feed channel the thread withdrawal channel is preferably separable.

13. The spinning arrangement according to claim 8, wherein the connecting channel is a separate bypass channel.

14. The spinning arrangement according to claim 9, wherein the connecting channel is a separate bypass channel.

15. The spinning arrangement according to claim 10, wherein the connecting channel is a separate bypass channel.

16. The spinning arrangement according to claim 9, wherein a cleaning channel, which is directed against the drafting unit during a spinning process, is provided as a bypass channel.

17. The spinning arrangement according to claim 10, wherein a cleaning channel, which is directed against the drafting unit during a spinning process, is provided as a bypass channel.

18. The spinning arrangement according to claim 11, wherein a cleaning channel, which is directed against the drafting unit during a spinning process, is provided as a bypass channel.

19. The spinning arrangement according to claim 13, wherein a cleaning channel, which is directed against the drafting unit during a spinning process, is provided as a bypass channel.

20. The spinning arrangement according to claim 13, wherein the bypass channel is provided with a closing device.

21. The spinning arrangement according to claim 15, wherein the bypass channel is provided with a closing device.

* * * * *